United States Patent [19]

Wolski

[11] Patent Number: 4,819,963

[45] Date of Patent: Apr. 11, 1989

[54] COMBINATION BOOK AND SCULPTURE

[76] Inventor: Bruce E. Wolski, P.O. Box 2024, Boulder, Colo. 80306

[21] Appl. No.: 40,807

[22] Filed: Apr. 21, 1987

[51] Int. Cl.[4] ..... B42D 1/00; B42D 15/00; G09F 19/00

[52] U.S. Cl. ..... 281/15.1; 283/64; 40/530

[58] Field of Search ..... 281/15 R, 29; 40/530, 40/486, 417, 158 R, 159, 124.1, 124.5; 446/369, 376, 371

[56] References Cited

U.S. PATENT DOCUMENTS

| | | | |
|---|---|---|---|
| D. 36,850 | 3/1904 | Rhoads | 283/64 |
| D. 38,643 | 6/1907 | Garman | 283/64 |
| 487,170 | 11/1892 | Bartholme | 40/530 |
| 667,578 | 2/1901 | Robichau | 40/530 |
| 771,671 | 10/1904 | Schwab | 40/530 |
| 1,010,949 | 12/1911 | Polverino | 40/530 |
| 4,509,280 | 4/1985 | Smith | 40/158 R |
| 4,597,743 | 7/1986 | Becker et al. | 281/15 R |
| 4,653,207 | 3/1987 | Wisniewski | 40/530 |

FOREIGN PATENT DOCUMENTS

| | | | |
|---|---|---|---|
| 216302A2 | 1/1987 | European Pat. Off. | 281/29 |
| 1131 | of 1913 | United Kingdom | 283/64 |

*Primary Examiner*—Frank T. Yost
*Assistant Examiner*—Paul M. Heyrana, Sr.
*Attorney, Agent, or Firm*—Donald W. Margolis

[57] ABSTRACT

A combination book and three-dimensional sculpture is provided, which sculpture has bifurcated first and second portions. The bifurcated portions of the sculpture are hingedly fastened along one mating marginal edge of said bifurcation. Included, in combination between said bifurcated portions, are one or more printable flat sheet which is bound along one marginal edge in registration with said bound marginal edge of said sculpture. The resulting combined structure provides an article having at least a first position, in which said sculpture is closed and appears to be a substantially continuous three-dimensional object, and a second position in which said sculpture is opened to reveal the space between said bifurcated portions, so that the one or more sheet is accessible. In the preferred embodiment, the sculpture is that of a character or of another item depicted in a story and/or pictures included as printed matter on said one or more sheet so that the reader, can imagine having contact with a character or other item set forth in the printed matter. The dimensions of the sheets and the sculpture are selected such that when the sculpture is in its closed position the sheets are not discernible. In one preferred embodiment the edges of the sheets are encompassed by and in substantial registration with the adjacent outer surfaces of the sculpture, whereby the edges of the sheets form a portion of the surface of the sculpture.

16 Claims, 1 Drawing Sheet

COMBINATION BOOK AND SCULPTURE

BACKGROUND OF THE INVENTION

1. Field of the Invention

The present invention relates to books, and particularly to books which also have combined utility as three dimensional sculptures. More particularly, the present invention relates to three-dimensional sculptures which are in the form of toys and which include books within their bodies. It also relates to books having three-dimensional entertainment and sculptural features.

2. Description of the Prior Art

It is sometimes difficult to interest young children in reading books. The prior art has addressed this problem by incorporating entertainment features into children's books to enhance the child's enjoyment, or by designing the books so that they are visually attractive and have eye-catching features. Such entertainment features have comprised, for example, pop-up figures, puppets or other items which are attached to or coordinated with a book. These entertainment features, however, are sometimes damaged or separated from the book during normal use. Such damage or separation may thereby cause the book to lose its interest and attractiveness to the child. Similarly educational books which provide instruction utilizing three-dimensional materials which are separate and distinct from the printed teaching and instructional materials are known in the art. However, because the three-dimensional portions are separate, they have the disadvantage that the instructions or the educational portion may be lost or misplaced from the three-dimensional portion, and thus render that portion substantially useless.

Substantially two dimensional books which are sculpted along their edges to represent an item or character are also known in the prior art. For example, in the prior art, U.S. Des. Pat. No. 143,943 and U.S. Pat. No. 4,597,743 teach and disclose substantially two-dimensional books in which the outside edges of an otherwise substantially flat book are shaped to represent a character or an item. In fact, U.S. Pat. No. 4,597,943 discloses books in the form of substantially two-dimensional wheeled vehicles having simulated wheel wells disposed adjacent the bottom edge of the book, and with three-dimensional wheels rotatably cantilever mounted at each of the simulated wheel wells. However, in this prior art patent, while the wheels themselves are three-dimensional, the wheels do not include any printed page portions, while the portion of the book which includes the printed pages is substantially flat and two-dimensional.

There is also in the prior art, U.S. Pat. No. 4,120,100 which teaches an educational book having especially configured printed pages. As the book is opened the pages may be folded, connected and assembled so that upon final completion of the book an outline representation of an overall three-dimensional geometric object has been formed. However, the normal configuration provided by this book, as it is read, is two-dimensional, and after the three-dimensional object has been formed the pages of the book cannot be readily accessed for reading. Similar prior art patents which may be pertinent to this invention are: U.S. Pat. Nos. 2,333,162; 2,354,381; and 3,248,806.

Also in the prior art, U.S. Pat. No. 4,487,590 discloses two-dimensional children's books in which there are structural openings adjacent to the edges of the book.

The printed matter depicts a scene and a steering wheel adjacent to the openings so that a child can place his fingers through those openings as if to grasp the steering wheel. This prior art, while providing some play or toy features, includes no substantial three-dimensional or sculptural features.

Therefore, there is a perceived need in the art for books which incorporate and combine three-dimensional structural features which permit the book to also function as a sculpture, and in certain instances take the form of a toy which can maintain a child's interest over a long period of time.

SUMMARY OF THE INVENTION

It is therefore an object of the present invention to overcome the prior art deficiencies detailed above.

A further object of the invention is to provide a three-dimensional sculpture including, in combination, a book.

Another object of the present invention is to provide a combination book and three-dimensional sculpture.

Another object of the present invention is to provide, in combination, a three-dimensional toy which includes in combination a book which may be readily opened to reveal printed text on pages within the toy.

The objects of the present invention are accomplished by the provision of a three-dimensional sculpture which is substantially bifurcated. The sculpture is then hingedly bound together along one marginal edge of said bifurcation. The bifurcated and bound sculpture thus provides a first position in which said bifurcated sculpture is closed and appears to be nothing more than a sculpture, and a second position in which said sculpture is opened along its hinged binding to reveal the space between its bifurcated portions. Now, according to the preferred practice of the present invention, there is included in combination within the space between said bifurcated portions of the sculpture, one or more printed or printable substantially flat sheets or pages. Where there is more than one sheet, the sheets are also bound together along one marginal edge. In preferred embodiments the bound edge of the sheets, or one edge of the single sheet if there is only one sheet, is substantially in registration with the bound edge of the bifurcated sculpture, and is hingedly bound together therewith. Thereby, in accordance with the practice of the present invention, when the sculpture is in its opened position the included sheet or sheets are accessible. When the sculpture is in its closed position the sheet or sheets are either an integral part of the surface of the sculpture or are hidden from view. In either event, when the sculpture is in its closed position, the sheets and are not accessible and the sculpture appears to be no more than a three-dimensional item.

As used herein and in the discussion of the prior art, the term "two-dimensional" does not mean an item which has only two dimensions in the geometric sense, but rather is intended to mean an item or article which encloses one or more flat sheet and which is substantially flat on at least the two opposed surfaces which are parallel to the enclosed sheet or sheets. By contrast, the term "three-dimensional," as used herein, is intended to mean an item or article which encloses one or more flat sheet, which item or article may be flat on one or more side, but which does not have a pair of opposed flat sides which are parallel to the enclosed sheets or sheets.

In one embodiment of the present invention, the three-dimensional sculpture may be that of a character or other item depicted in a story and/or in pictures included as printed matter on the sheets that are combined with the sculpture. The reader, therefore, can imagine herself or himself as having real three-dimensional contact with a character or with some other item set forth in the printed matter on the sheets.

In the practice of the present invention the dimensions of the sheets and of the sculpture are selected such that when the sculpture is in irs closed position the sheets are not substantially discernible and the sculpture appears to be nothing more than a three-dimensional object. In one such embodiment the edges of the sheets, including the bound edges of the sheets, are in substantial registration with the adjacent outer surfaces of the sculpture. In such an embodiment, the edges of the sheets will form a portion of the surface of the sculpture. In another embodiment the sheets are substantially completely encompassed between and within the bifurcated halves of the sculpture and form no substantial part of the surface of the sculpture.

A child's book with such three-dimensional sculpture features and in the form of a toy should be rugged and durable. It is also seen that the system of the present invention comprises the concept of combining a conventional book with a toy, thereby altering the traditional perception of each as having a separate function.

For a fuller understanding of the nature and objects of the present invention, reference should be made to the following derailed description taken in conjunction with the accompanying drawings.

BRIEF DESCRIPTION OF THE DRAWINGS

The accompanying drawings illustrate complete preferred embodiments of the present invention according to the best modes presently conceived for the practical application of the principles thereof, and in which:

Now, referring to FIG. 1, there is shown an isometric view of a three-dimensional sculpture in the form of a fanciful toy fish, generally 2. As shown in FIG. 1, fish 2 is a combination book and sculpture, in a closed position, for use as a sculpture or as a toy.

Figure 4:
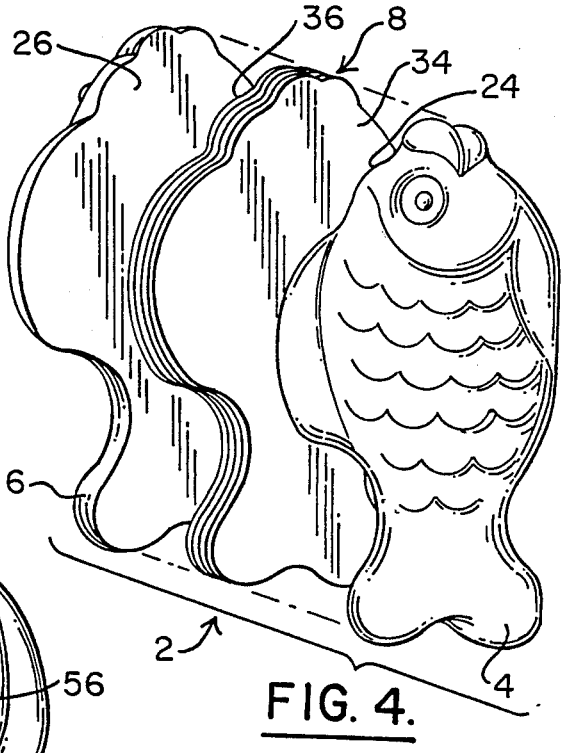
FIG. 4 is a slightly reduced, isometric, exploded top view of the combination book and sculpture of FIG. 1 showing the two bifurcated portions of the sculpture and a number of intermediate bound sheets.

As shown most clearly in the exploded view of FIG. 4, sculpture 2 is divided or substantially bifurcated into a first half 4, and a second half 6, with a plurality of conventionally bound sheets, generally 8, there-in-between. As used herein, the term "half" or "halves", may mean either equal or unequal portions. In many instances the sculpture will have bilateral symmetry, and the bifurcation of the sculpture may be most easily and effectively accomplished along the plane of symmetry so that each half or portion is of about equal size.

First half 4 has an inner surface 14 and adjacent peripheral edge 24, while second half 6 has an inner surface 16 and adjacent peripheral edge 26. The first half 4 and the second half 6 of sculpture 2 are bound together along their pair of adjacent peripheral edges 24 and 26, respectively, by bound sheets 8. It will be noted that bound sheets 8 include a plurality of sheets, including a first sheet 34 and a last sheet 36. In the embodiment shown in FIGS. 2 and 3, bound sheets 8 are used to accomplish the binding of first half 4 to second half 6 by securing or adhering outer surface of outer sheet 34 to inner surface 24 of first half 4 and the outer surface of sheet 36 to inner surface 26 of second half 6. Thus, bound sheets 8 serve to hingedly fasten sculpted halves 4 and 6 together as an integral unit.

Figure 1:
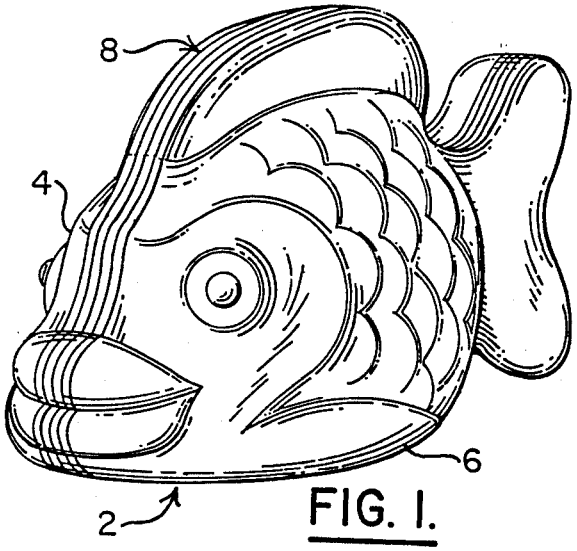
FIG. 1 is an isometric view of a combination book and fanciful fish sculpture in a closed position, according to one mode of the invention, for use as a sculpture or as a toy fish.
Figure 3:
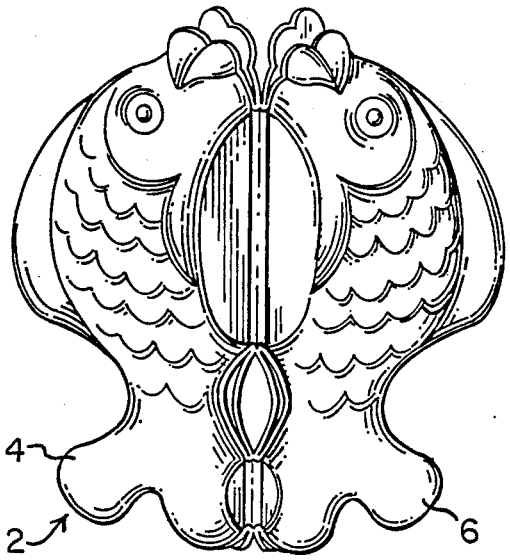
FIG. 3 is a slightly reduced, isometric, bottom view of the combination book and sculpture of FIG. 1 in an open position.
Figure 2:
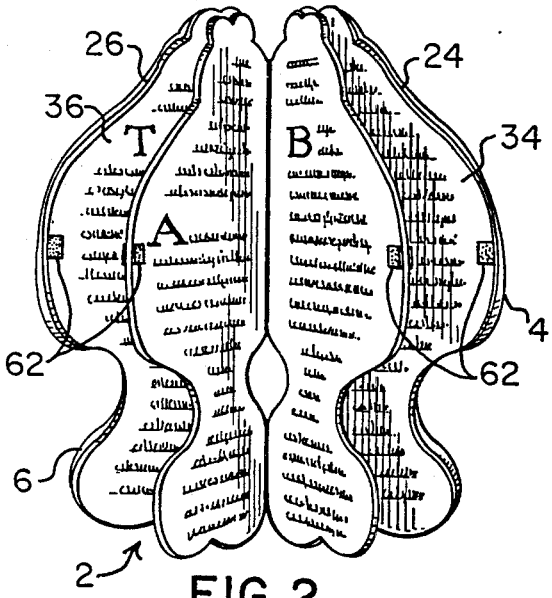
FIG. 2 is a slightly reduced, isometric, top view of the combination book and sculpture of FIG. 1, with the two portions of the sculpture in an open position in which the sheets within the sculpture are accessible for viewing and reading.

The thus bound, bifurcated sculpture 2 is capable of providing a first position, as shown in FIG. 1, in which said sculpture is closed and thus appears to be nothing more than a three-dimensional sculpture, in this case a fanciful toy fish. The bound, bifurcated sculpture 2 is also capable of providing a second general position, as shown in FIGS. 2 and 3, in which the bifurcated halves 4 and 6 of said sculpture are opened at their hinged connection to reveal the space there-in-between. Included in combination, within the space between said bifurcated halves 4 and 6, is one or more printable, substantially flat sheet, generally 8. Where there is more than one sheet, as shown in FIGS. 1 through 4, sheets 8 may be secured together along one of their common marginal edges using conventional binding techniques such as stitching and gluing. In the preferred embodiment shown, the bound edges of the sheets 8 are in substantial registration with, and carry the form of adjacent inner edges 24 and 26 of bifurcated sculpture 2, and are substantially bound together therewith. Thereby, in accordance with the practice of the present invention, when the sculpture is in its open position, as shown in FIGS. 2 and 3, bound sheets 8 are accessible. When sculpture 2 is in its closed position, as shown in FIG. 1, the edges of sheets 8, including the bound edges are in substantial registration with the adjacent outer surfaces of halves 4 and 6 of the sculpture. Thus, in the embodiment shown in FIGS. 1–4, the edges of sheets 8 are in substantial registration with the adjacent circumferential surfaces of the sculpted halves, to thereby form an integral portion of the surface of sculpture 2. Thus, when sculpture 2 is in its closed position, sheets 8 are hidden and are not accessible so that sculpture 2 appears to be no more than a three-dimensional sculpture, in this case a fanciful toy fish.

Figure 5:
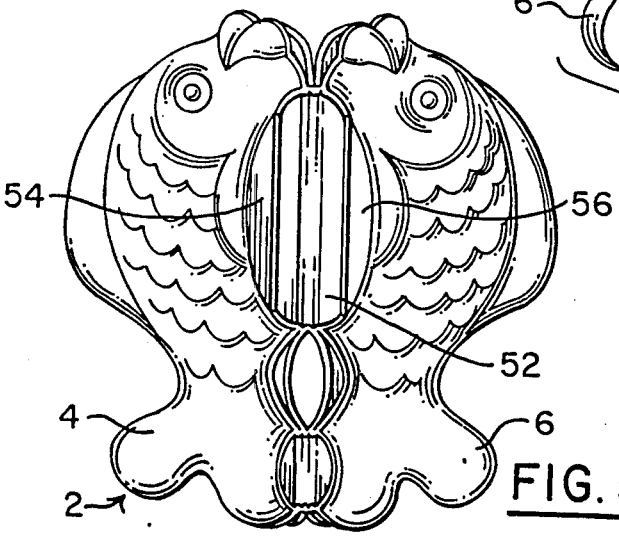
FIG. 5 is an isometric, bottom view of a modified form of a combination book and sculpture according to the present invention, in which the bifurcated portions of the sculpture are bound together in a different way, and in which the sheets are sized to be completely encompassed by the bifurcated portions when they are in their closed position.

Now, referring to FIG. 5, there is shown an isometric, bottom view of a modified form of a combination book and sculpture according to the present invention. In this modified embodiment the sheets within the sculpture are bound to bifurcated halves 4 and 6 of the sculpture in a different manner than in the embodiment shown in FIGS. 2 and 3. The first half 4 and the second half 6 of sculpture 2 are bound together, along their adjacent peripheral edges, 24 and 26 respectively, by hinge strip 52 which extends along substantially flat bottom portions 54 and 56, respectively. Hinge strip 52 is preferably a flexible web, and may also be an extension of one or more sheet. In the embodiment shown in FIG. 5, the dimensions of the sculpted halves and of the sheets have been designed so that the sheets are substantially completely encompassed by the circumferential edges of the sculpted halves, instead of having the sheets in substantial registration with the adjacent circumferential surfaces of the sculpted halves. Thus, in this embodiment also, when sculpture 2 is in its closed position, the bound sheets are hidden and are not accessible so that sculpture 2 appears to be no more than a three-dimensional sculpture, in this case a fanciful toy fish.

The sculptures of the present invention may be made by using any number of conventional and art known techniques and materials. In most instances the materials will be chosen to produce relatively light weight durable sculptures. Where the sculptures are intended for use by children as toys, consideration will be given to using materials which are resistant to breakage, water, dirt and grease, and which will even be capable of being cleaned and/or immersed in water. Therefore some materials of choice for such sculptures will include plastic or wood. Another useful material, which has the benefit of being inexpensive and easily produced is paper mache' including a plaster-of-paris base. Of course, any other suitable material can be used to form the sculpture. When the sculpture is intended to have utility as a toy, what ever material is chosen for the sculpture will also be selected so as to be non-toxic. The sculpture may be solid, or, in order to reduce its weight it may be hollow. The exterior of the sculpture may remain as it is produced, unpainted and undecorated, but it may also be painted or decorated.

The individual pages, are designed so as to be easily die-cut and printed with the appropriate educational material thereon before they are combined with the book in order to avoid excessive manufacturing or printing costs. The pages may also be printed first and then die-cut, the order of the manufacturing process being relatively immaterial. However, the individual pages will be designed so that they can be readily manufactured utilizing economical art known mass printing and production techniques.

Sheers or pages 8 within the sculpture may be composed of any substantially flat printable material, including, for example paper, from ordinary weight to heavy cardboard, and even wood, in some embodiments of the device. Also, water resistant plastic materials and plastic impregnated cloth materials may be used to form the sheets or pages. Plastics and cardboard are of course particularly attractive choices when the sculpture will be in the form of a toy intended for use by a child.

The outermost sheets 34 and 36 of binding hinge 52 may be adhered to the sculpture by means of adhesive or by mechanical fastening means. When the sculpture is molded from plastic, the sheets may even be molded in place between the sculptured halves. However, in the preferred practice of the present invention, the book pages are bound first and then have the exterior sculpture adhered or otherwise connected to them.

The sculpture is most effectively designed with the hinged portion carried by a substantially flat or slightly concave base surface, so that the sheet or sheets are at an angle normal to the base. This structure is preferred, since when the base surface rests on a supporting surface pressure is exerted on halves 4 and 6 of the sculpture to cause the book/sculpture to assume its closed position, without the need to use any closure device. However, in other instances closure means 62, at the edges of the sculpted halves and/or at the edges of the sheets which are opposed to the hinge, are provided so that the sculpture may be fastened closed. Closure means 62 may be, for example hook and loop material known as Velcro, or snaps or other art known closure means. Closure means 62 may also include magnetic or magnetically attracted material. Alternatively, pages 8 may be composed either along their edges or in their entirety of magnetic material which, when closed, will cause the sculpted halves and pages to maintain their closed position. It will also be possible to use any convenient standard hardware to latch halves 4 and 6 together.

It is therefore seen that the present invention overcomes the deficiencies of the known prior art books which included three-dimensional features and accomplishes the objects of the present invention. This is done by providing a three-dimensional sculpture including a book. This is further accomplished by providing a combination book and three-dimensional sculpture. Additionally, the present invention provides a three-dimensional toy which includes in combination a book which may be readily opened to reveal printed text on sheets within the toy.

While the embodiment shown illustrates a combination book and three-dimensional sculpture in the form of a fish, other embodiments in the form of other three-dimensional objects are intended to be equivalent thereto. Furthermore, although the system of the present invention is designed to function both as a book and as a toy, it may also be distributed and sold as a toy alone, or as a book alone.

While the invention has been particularly shown and described with reference to preferred embodiments thereof, it will be understood by those skilled in the art that the foregoing and other modifications or changes in form and details may be made therein without departing from the spirit and scope of the invention as claimed, except as precluded by the prior art.

The invention in which an exclusive right and privilege is claimed is:

1. A combination book and three-dimensional sculpture system, including:

a bifurcated three-dimensional sculpture including a first three-dimensional portion and a second three-dimensional portion, said first and second three-dimensional portions defining between them a plurality of pairs of mating, substantially adjacent circumferential edges;

means for hingedly fastening together said first and second sculpture three-dimensional portions at one pair of said mating, substantially adjacent, circumferential edges so that said first and second three-dimensional sculpture portions can be either closed, or pivoted away from one another to create a space therein-in-between; and one or more printed or printable sheet, between said bifurcated first and second sculpture portions, each of said one or more sheet having marginal edges, one said marginal edge of each said one or more sheet being in substantial registration with, and also connected in combination with said hingedly fastening means, and wherein further the marginal dimensions of said one or more sheet and the marginal dimensions of said sculpture are selected, such that when said first and second three-dimensional portions of said sculpture are in their closed position, said one or more sheets are not readily discernible; whereby said system provides at least a first position, in which said sculpture is closed and appears to be a substantially continuous, monolithic three-dimensional object, and a second position in which said first and second three-dimensional sculpture portions are pivoted away from one another at said hingedly fastening means, so that said sculpture is open and reveals and makes accessible said one or more sheet connected in combination between said first and second portions of said sculpture.

2. The combination book and sculpture of claim 1 wherein the said one or more sheet is substantially flat.

3. The combination book and sculpture of claim 1 wherein there is more than one sheet, and wherein said sheets are hingedly bound together at one of their said marginal edges, said bound marginal edges of said sheets being in registration with and connected to said means for hingedly fastening together said first and second portions of said sculpture.

4. The combination book and sculpture of claim 3 wherein there is at least a first sheet and a last sheet, said first sheet and said last sheet each having an outer surface, and wherein said first and second portions of said sculpture each have an inner surface, and wherein further said outer surface of said first sheet is connected to said inner surface of said first portion of said sculpture and said outer surface of said last sheet is connected to said inner surface of said second portion of said sculpture.

5. The combination book and sculpture of claim 4 wherein said first and last sheets constitute at least a portion of said means for hingedly fastening together said first and second portions of said sculpture.

6. The combination book and sculpture of claim 4 wherein said first and last sheets constitute substantially the entire means for hingedly fastening together said first and second sculptured portions.

7. The combination book and sculpture of claim 1 wherein said means for hingedly fastening together said first and second sculptured portions is a hinge which is substantially external to said sculptured portions, and wherein said hinge is connected to one said pair of mating circumferential edges of said first portion and said second portion of said sculpture.

8. The combination book and sculpture of claim 7 wherein said hinge is composed of substantially flexible web material.

9. The combination book and sculpture of claim 8 wherein said flexible web material of said hinge is an extension of said one or more sheet.

10. The combination book and sculpture of claim 1, wherein the marginal dimensions of said one or more sheet and of the sculpture are selected such that the edges of said one or more sheet are substantially encompassed by said circumferential edges of said first and second portions of said sculpture, whereby said sheets are substantially hidden when said first and second portions of said sculpture are in their closed position.

11. The combination book and sculpture of claim 1, wherein said first and second portions of said sculptures are substantially equal in size, each portion constituting about one half of said sculpture, by size.

12. The combination book and sculpture of claim 11, wherein said sculpture is substantially bilaterally symmetrical, and bifurcated along the plane of symmetry of the sculpture.

13. The combination book and sculpture of claim 1, wherein said one or more sheet is composed of water resistant material.

14. The combination book and sculpture of claim 1 wherein closure means are provided for holding said first and second three-dimensional portions of said sculpture in their closed position.

15. A combination book and three-dimensional sculpture system, including in combination:

a bifurcated three-dimensional sculpture including a first three-dimensional portion and a second three-dimensional portion, said first and second three-dimensional portions each having a plurality of substantially mating circumferential edges;

means for hingedly binding together one portion of said substantially mating circumferential edges of each of said first and second three-dimensional sculpture portions so that said first and second portions can be either closed or pivoted away from one another to create a space there-in-between; and included, in combination between said bifurcate d first and second portions, one or more printed or printable sheet, said one or more sheet having marginal edges, one said marginal edge of said one or more sheet being in substantial registration with said hingedly bound edge of said first and second portions of said sculpture are pivoted away from one another at said hingedly binding means, said one or more sheet can be accessed, and wherein further the marginal dimensions of said one or more sheets and the marginal dimensions of said sculpture are selected such, that when said first and second portions of said sculpture are in their closed position, that at least a portion of the edges of said one or more sheet, including the bound edge of said one or more sheet, are in substantial registration with said adjacent outer circumferential surfaces of said first and second portions of said sculpture, whereby said marginal edges of said one or more sheet form a portion of the surface of said sculpture and are not readily discernible; whereby said system provides at least a first position, in which said sculpture is closed and appears to be a substantially continuous, monolithic three-dimensional object, and a second position, in which said first and second three -dimensional sculpture portions are pivoted away from one another at said hingedly binding means so that said sculpture is open and reveals said one or more sheet between said first and second portions of said sculpture.

16. The combination book and sculpture of claim 15 wherein said bound edge of said one or more sheet is in substantial registration with said means for hingedly fastening said first and second portion of said sculpture.

* * * * *